US008899351B2

(12) United States Patent
Hay et al.

(10) Patent No.: US 8,899,351 B2
(45) Date of Patent: Dec. 2, 2014

(54) APPARATUS AND METHOD FOR ADJUSTING POWER UNITS OF DOWNHOLE MOTORS

(75) Inventors: Richard Thomas Hay, Spring, TX (US); Robello Samuel, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/236,057

(22) PCT Filed: Jul. 16, 2012

(86) PCT No.: PCT/US2012/046875

§ 371 (c)(1),
(2), (4) Date: Jan. 29, 2014

(87) PCT Pub. No.: WO2014/014442

PCT Pub. Date: Jan. 23, 2014

(65) Prior Publication Data

US 2014/0158426 A1 Jun. 12, 2014

(51) Int. Cl.

| | |
|---|---|
| ***E21B 4/02*** | (2006.01) |
| ***F01C 1/10*** | (2006.01) |
| ***F04C 2/107*** | (2006.01) |
| ***F04C 14/20*** | (2006.01) |

(52) U.S. Cl.

CPC ..... *E21B 4/02* (2013.01); *F04C 2/1071* (2013.01); *F04C 14/20* (2013.01)

USPC ..... 175/57; 175/48; 175/107; 418/48; 418/153; 418/83

(58) Field of Classification Search

USPC ..... 175/48, 57, 107; 418/48, 152, 153, 178, 418/179, 83

See application file for complete search history.

(56) References Cited

U.S. PATENT DOCUMENTS

| | | | |
|---|---|---|---|
| 3,840,080 | A | 10/1974 | Berryman |
| 3,912,426 | A | 10/1975 | Tschirky |

(Continued)

FOREIGN PATENT DOCUMENTS

| | | |
|---|---|---|
| CA | 2058080 | 6/1992 |
| CN | 201937380 | 8/2011 |

(Continued)

OTHER PUBLICATIONS

Authorized Officer Schneiderbauer, K, International Search Report/ Written Opinion for International Application No. PCT/US2012/ 046875, mailed Feb. 27, 2013, 12 pages.

(Continued)

*Primary Examiner* — Robert E Fuller

(74) *Attorney, Agent, or Firm* — Alan Bryson; Fish & Richardson P.C.

(57) ABSTRACT

A downhole drilling motor for well drilling operations includes a tubular housing and a stator disposed in the tubular housing. The stator defines an internal cavity passing therethrough, wherein the stator includes one or more lobes defining at least a portion of the cavity. A rotor is operatively positioned in the internal cavity to cooperate with the one or more lobes of the stator. At least a portion of the stator or of the rotor comprises a memory material adapted to expand or contract when heat is applied by a localized heating module to the memory material. A fluid escape gap between the rotor and stator is adjusted by applying heat to the rotor and/or stator. At least one controller is adapted to receive input data and provide output signals increasing and/or decreasing electrical current applied to the at least one localized heating module.

29 Claims, 7 Drawing Sheets

(56) References Cited

U.S. PATENT DOCUMENTS

| | | | | |
|---|---|---|---|---|
| 4,415,316 | A | 11/1983 | Jurgens | |
| 4,636,151 | A | 1/1987 | Eppink | |
| 5,090,497 | A | 2/1992 | Beimgraben et al. | |
| 5,171,138 | A | 12/1992 | Forrest | |
| 5,417,281 | A | 5/1995 | Wood et al. | |
| 5,759,019 | A | 6/1998 | Wood et al. | |
| 6,183,226 | B1 | 2/2001 | Wood et al. | |
| 6,268,911 | B1 * | 7/2001 | Tubel et al. | 356/72 |
| 6,763,899 | B1 | 7/2004 | Ossia et al. | |
| 6,905,319 | B2 | 6/2005 | Guo | |
| 8,056,618 | B2 * | 11/2011 | Wagner et al. | 166/57 |
| 2003/0143094 | A1 | 7/2003 | Guo | |
| 2006/0048936 | A1 | 3/2006 | Fripp et al. | |
| 2006/0153724 | A1 | 7/2006 | Delpassand | |
| 2010/0038142 | A1 * | 2/2010 | Snyder et al. | 175/107 |
| 2011/0070111 | A1 | 3/2011 | Slay et al. | |
| 2011/0217170 | A1 | 9/2011 | Buffone et al. | |

FOREIGN PATENT DOCUMENTS

| | | |
|---|---|---|
| JP | 63266190 | 11/1988 |
| JP | 11346490 | 12/1999 |
| SU | 1740785 | 6/1992 |

OTHER PUBLICATIONS

Halliburton, "Pilot™ Fleet," Sperry Drilling Services, H05544, Aug. 2008, 14 pages.

Authorized officer Nathalie Kermani, International Search Report and Written Opinion in International Application No. PCT/US2012/046875, mailed on Feb. 27, 2013, 14 pages.

Halliburton, "Pilot™ Fleet", Sperry Drilling Services, H05544, Aug. 2008, 14 pages.

* cited by examiner

APPARATUS AND METHOD FOR ADJUSTING POWER UNITS OF DOWNHOLE MOTORS

TECHNICAL FIELD

This disclosure is directed generally towards downhole motors, and, in particular, downhole drilling motors used in oil and gas wellbore drilling applications.

BACKGROUND

Progressing cavity motors, also known as Moineau-type motors having a rotor that rotates within a stator using pressurized drilling fluid have been used in wellbore drilling applications for many years. Some Moineau-type pumps and motors used in wellbore drilling include stators having rubber or elastomer materials bonded to a steel structure. Pressurized drilling fluid (e.g., drilling mud) is typically driven into the motor and into a cavity between the rotor and the stator, which generates rotation of the rotor and a resulting torque can be produced. The resulting torque is typically used to drive a working tool, such as a drill bit, to cut material.

SUMMARY

In one aspect, a downhole drilling motor for well drilling operations includes a tubular housing; a stator disposed in the tubular housing, wherein the stator defines an internal cavity passing therethrough. The stator includes one or more lobes defining at least a portion of the cavity; and a rotor operatively positioned in the internal cavity to cooperate with the one or more lobes of the stator. At least a portion of the stator or at least a portion of the rotor comprises a memory material adapted to expand or contract when heat is applied by a localized heating module to the memory material. A fluid escape gap between the rotor and stator is adjusted by applying heat to the rotor and/or stator. At least one controller is adapted to receive input data and provide output signals increasing and/or decreasing electrical current applied to the at least one localized heating module. In some embodiments, the stator comprises an outer portion and an inner portion and at least a portion of the outer portion is comprised of the memory material. The rotor may further include a pressure sensor that is configured to detect the pressure within the cavity and provide the pressure data to the controller. The pressure sensor may be configured to detect the pressure within the cavity and provide the pressure data to the controller. In some embodiments, the outer portion of the stator substantially defines the internal cavity and the inner portion has a generally consistent thickness and is disposed along an inner surface of the outer portion. In some implementations, the outer portion of the stator is a sleeve having a generally consistent thickness and the inner portion substantially defines the internal cavity. In some embodiments, the inner portion of the stator is comprised of rubber. In some embodiments, the memory material is a shape memory alloy.

In another aspect, a downhole drilling motor for well drilling operations is comprised of a tubular housing; a stator disposed in the tubular housing, the stator having an internal cavity passing therethrough, wherein the stator includes one or more lobes defining at least a portion of the cavity, the stator comprising a wire frame structure that generally defines the internal cavity, a portion of the stator being comprised of a memory material and adapted to expand and contract based on increasing or decreasing electric current applied to the memory material; and at least one electrical control device configured to increase or decrease electric current supplied to the memory material; and a rotor operatively positioned in the internal cavity to cooperate with the one or more lobes of the stator. A fluid escape gap between the rotor and stator is adjusted by applying heat to the rotor and/or stator. A controller is adapted to receive input data and provide output signals increasing and/or decreasing electrical current applied to the memory material. In some implementations, the stator further comprises a pressure sensor that is configured to detect the pressure within the cavity and provide the pressure data to the controller.

In another aspect, a rotor for use in a downhole drilling motor for well drilling operations is configured to be operatively positioned within an internal cavity of a stator disposed in the tubular housing of the downhole drilling motor, the rotor adapted to cooperate with the one or more lobes of the stator, the rotor comprising: at least one pressure sensor configured to detect the pressure within the internal cavity and provide pressure data to the controller; and at least a portion of the rotor comprises a memory material adapted to expand or contract when electric current applied to the memory material is increased or decreased by a controller disposed in the motor.

In one or more specific aspects, the method of operating a downhole drilling motor in a well drilling operation can include the steps of: introducing a drilling fluid into a first end of a downhole drilling motor; forcing the drilling fluid through a cavity between a rotor and a stator of the downhole drilling motor with sufficient pressure to cause the rotor to rotate relative to the stator; with a controller disposed in the downhole drilling motor, monitoring the pressure of the drilling fluid in at least one portion of the cavity between the rotor and stator; and responsive to the pressure in the at least one portion of the cavity, selectively providing heat to a portion of the stator or rotor formed from a memory material disposed proximal to the cavity, expanding or contracting the memory material to reduce or increase a spacing between the rotor and that stator in the at least one region.

In another aspect, the method of operating a downhole drilling motor in a well drilling operation can include the steps of: introducing a drilling fluid into a first end of a downhole drilling motor; forcing the drilling fluid through a cavity between a rotor and a stator of the downhole drilling motor with sufficient pressure to cause the rotor to rotate relative to the stator; with a controller disposed in the downhole drilling motor, monitoring the pressure of the drilling fluid in at least one portion of the cavity between the rotor and stator; and responsive to the pressure in the at least one portion of the cavity, selectively providing electric current to a portion of the stator or rotor formed from a memory material disposed proximal to the cavity, expanding or contracting the memory material to reduce or increase a spacing between the rotor and that stator in the at least one region.

In some implementations, the pressure of the drilling fluid is monitored and the rotor and/or the stator are enlarged at multiple regions along the downhole drilling motor.

Data received by the controller is selected from the group consisting of: motor RPM, input drilling fluid flow rate, output torque; motor differential pressure; and motor gradient pressure. In some implementations, the controller calculates a motor efficiency. The motor efficiency is adjusted by expanding or contracting the memory material to adjust the spacing between the stator and rotor. Output torque of the motor can be adjusted by controlling the fluid gap between the rotor and stator. Rotational speed of the motor can be adjusted.

Embodiments can include one or more of the following advantages.

The systems and methods described in this disclosure can help increase or extend the usable life of a downhole motor power unit used in a wellbore drilling assembly. The extended usable life can be achieved by dynamically monitoring the fluid pressure within the power unit and moving the power unit's rotor and stator relative to one another to control the spacing between them, for example, as portions of the rotor or the stator become worn during use. For example, moving the rotor and the stator relative to one another to reduce the spacing between the rotor and the stator can permit a drilling assembly operator to continue using a worn power unit that would typically otherwise need to be withdrawn from a partially formed wellbore and replaced with a new power unit.

The systems and methods described in this disclosure can also help adjust (e.g., improve, tune, or optimize) the efficiency of the downhole motor power unit by adjusting the spacing between the rotor and the stator at different regions along the power unit as needed to optimize the performance of that particular region. Adjusting the spacing at different regions allows for adjusting the fluid pressure at the different regions.

The details of one or more embodiments are set forth in the accompanying drawings and the description below. Other aspects, features, and advantages of the invention will be apparent from the description and drawings, and from the claims.

DETAILED DESCRIPTION

Progressing cavity motors, such as those used in downhole drilling and pump assemblies typically include a stator defining cavity and a rotor that is sized and configured to rotate within the cavity when pressurized fluid is applied to the cavity. The rotor and/or the stator can be formed of an adjustable material, such as a shape memory alloy, so that a spacing between the rotor and the stator can be maintained (e.g., optimized), for example, when a portion of the rotor or the stator is worn away during use.

Figure 1:
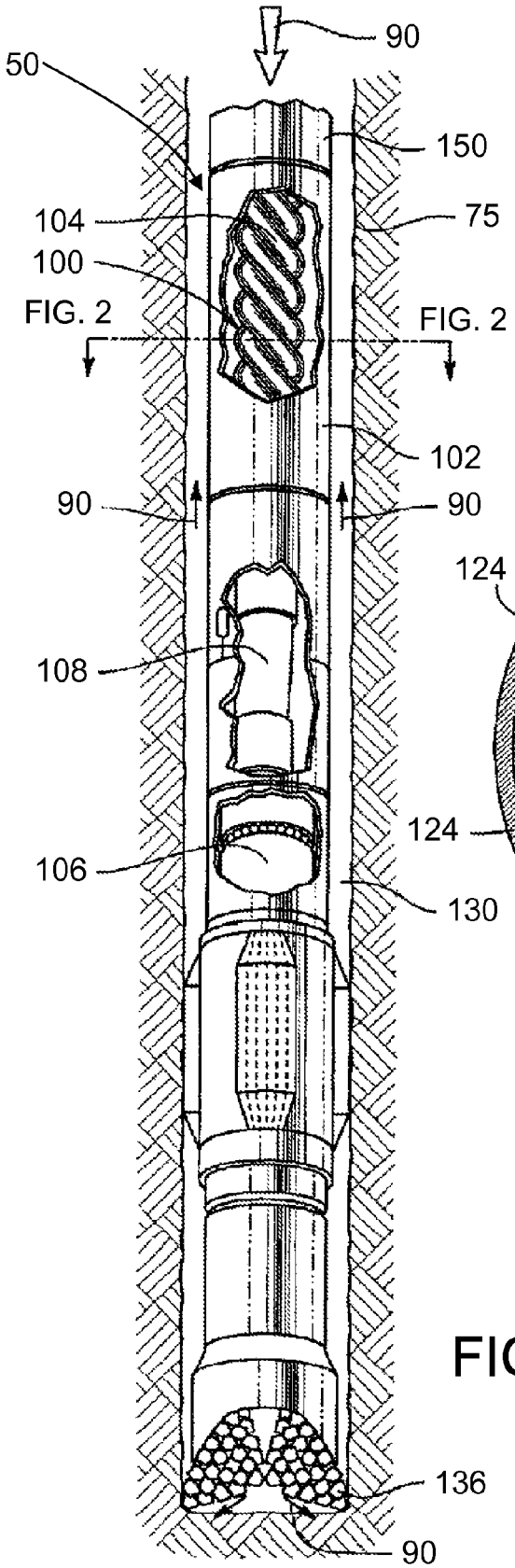
FIG. 1 illustrates a side view of an example downhole drilling assembly including a downhole drilling motor with portions of a tubular housing cut away for illustrating internal features of the downhole drilling motor.
Figure 2:
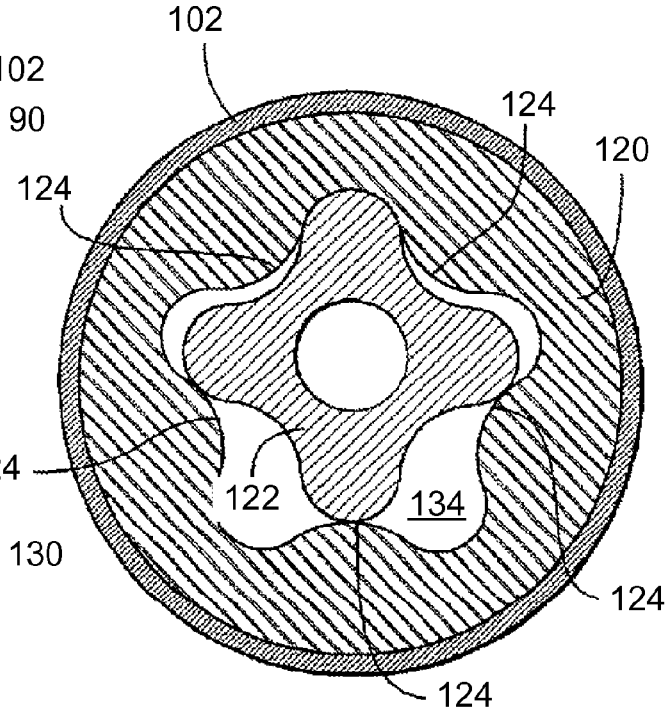
FIG. 2 is a cross-sectional view of a rotor of the downhole drilling motor of FIG. 1 operatively positioned in a cavity defined by a stator disposed in the tubular housing.

FIG. 1 illustrates an example drilling assembly 50 disposed in a wellbore 75. The drilling assembly 50 includes a downhole motor 100 connected to a drill bit 136. The downhole motor 100 generally includes a tubular housing 102, which is typically formed of steel, that encloses a power unit 104. The power unit 104 is connected to a bearing section assembly 106 via a transmission unit 108. The power unit 104 includes a stator 120 and a rotor 122. Referring to FIG. 2, the stator 120 includes multiple (e.g., five) lobes 124 defining a cavity 134. The stator 120 and rotor can also have more or fewer lobes where the difference between the rotor and stator lobes is 1 extra lobe for the number of rotor lobes. See exemplary configurations in FIGS. 7A to 7K.

The rotor 122 is operatively positioned in the cavity 134 to cooperate with the stator lobes 124. Applying fluid pressure to the cavity 134 typically causes the rotor 122 to rotate within the stator 120 in cooperation with the lobes 124. For example, referring to FIGS. 1 and 2, pressurized drilling fluid (e.g., drilling mud) 90 can be introduced at an upper end of the power unit 104 and forced down through the cavity 134. As a result of the pressurized drilling fluid 90 flowing through the cavity 134, the rotor 122 rotates which causes the drill bit 136 to rotate and cut away material from the formation. From the cavity 134, the drilling fluid 90 is expelled at the lower end and then subsequently exhausted from the drill bit 136.

During a drilling operation, the drilling fluid 90 is pumped down the interior of a drill string 150 (shown broken away) attached to downhole drilling motor 100. The drilling fluid 90 enters cavity 134 having a pressure that is a combination of pressure imposed on the drilling fluid by pumps (e.g., pumps at the surface) and the hydrostatic pressure of the above column of drilling fluid 90. The pressurized drilling fluid entering cavity 134, in cooperation with the lobes 124 of the stator 120 and the geometry of the stator 120 and the rotor 122 causes the lobes 124 of the stator to deform and the rotor 122 to turn to allow the drilling fluid 90 to pass through the motor 100. The drilling fluid 90 subsequently exits through ports (e.g., jets) in the drill bit 136 and travels upward through an annulus 130 between the drill string 150 and the wellbore 75 and is received at the surface where it is captured and pumped down the drill string 150 again.

These downhole drilling motors fall into a general category referred to as Moineau-type motors. Additional detailed description of Moineau-type motors can be found in U.S. Pat. Nos. 3,840,080; 3,912,426; 4,415,316; 4,636,151; 5,090,497; 5,171,138; 5,417,281; 5,759,019; 6,183,226; and 6,905,319 and Canadian Patent No. 2,058,080, the contents of which are hereby incorporated herein by reference for their teachings concerning Moineau-type motors. Downhole motors are, however, generally subjected to greater torqueing loads than simple worm pumps that also fall into the general category of Moineau-type motors. This is particularly true with high power density (HPD) downhole motors used in oil and gas well drilling.

Some conventional Moineau-type pumps and motors include stators that have stator contact surface formed of a rubber or elastomer material bonded to the steel housing. However, in the dynamic loading conditions typically involved in downhole drilling applications, substantial heat can be generated in the stator and the rotor. Since rubber is generally not a good heat conductor, thermal energy is typically accumulated in the components that are made of rubber (e.g., the stator). This thermal energy accumulation can lead to thermal degradation and, therefore, can lead to damage of the rubber components and to separation of the rubber components from the housing.

Additionally, in some cases, the drilling fluid to be pumped through the motor is a material that includes hydrocarbons. For example, oil-based or diesel-based drilling fluids can be used which are known to typically deteriorate rubber. Such deterioration can be exacerbated by the accumulation of thermal energy. Even water can present a problem in drilling applications.

For optimum performance of the drilling motor, there is typically a certain required spacing (e.g., clearance) between the rubber parts of the stator and the rotor. When the rubber swells, not only the efficiency of the motor is affected but also the rubber is susceptible to damage because of reduced clearance between the rotor and the stator. The reduced clearance typically induces higher loads on the rubber.

Contact between the stator and the rotor during use can cause these components to wear (i.e., the rubber portion of the stator or the rotor), which results in the spacing between the stator and the rotor to increase. In some cases, the rotor or the stator can absorb components of the drilling fluid and swell, which can result in the clearance getting smaller and causing portions of the rotor or stator wearing and breaking off. This wear is generally known as chunking In some cases, the chunking of the material can result in significant pressure loss so that the power unit is no longer able to produce suitable power levels to continue the drilling operation. Additionally or alternatively, in some cases, chemical components in the drilling fluid used can degrade the rotor or the stator and cause the spacing between them to increase. Since the adequate (e.g., efficient) operation of the power unit typically depends on the desired spacing (e.g., a small spacing), the stator and/or the rotor can be adjusted to maintain the desired spacing as these components wear during use.

To adjust the spacing and counteract the wearing components, some components of the power unit, such as the stator or the rotor, can be formed of a material that permits the size or shape of the component to be adjusted during use. For example, the stator and/or the rotor can be made of a metallic material that "remembers" its original shape and can deflect or expand when heat or an electric current is applied. Examples of such materials include shape memory alloys, such as nickel-titanium alloys (e.g., Nitinol), copper-aluminum-nickel alloys, copper-zinc-aluminum alloys, and iron-manganese-silicon alloys. Many other alloys such as these exist which exhibit memory metal properties.

Figure 3:
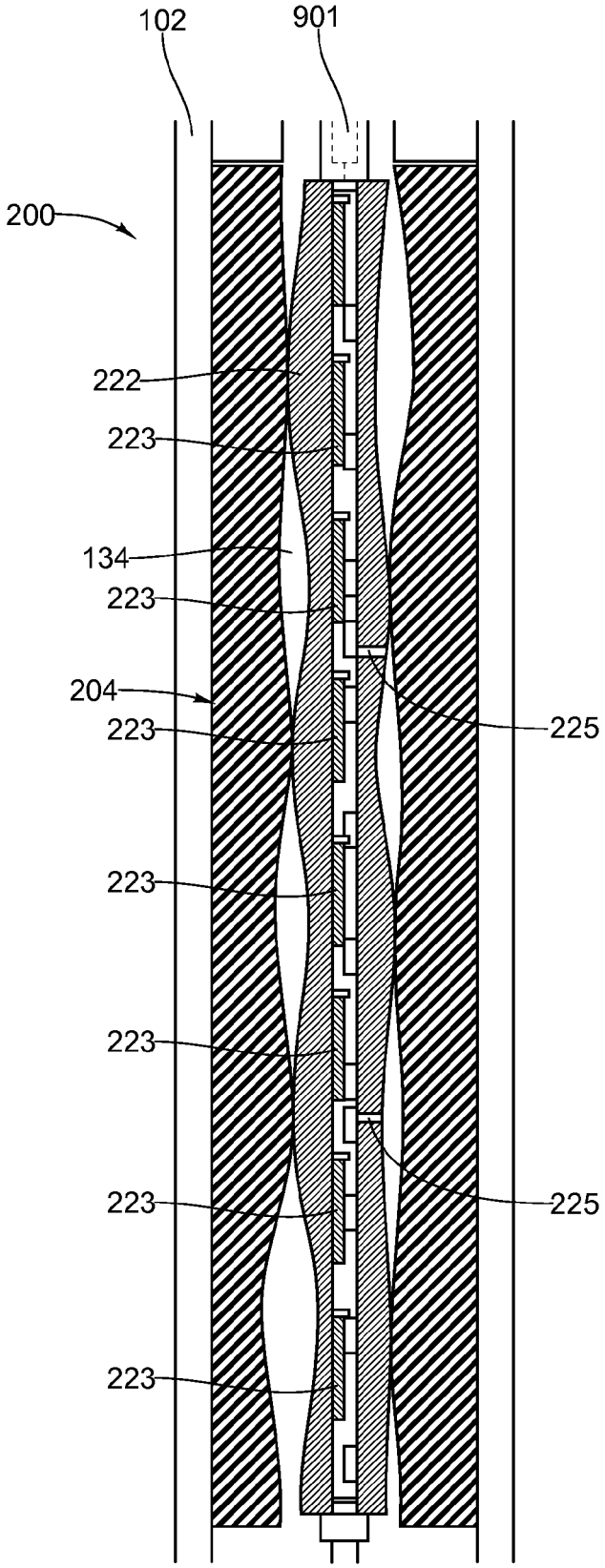
FIG. 3 is a cross-sectional view of an example downhole drilling motor power unit having a rotor formed of a shape memory alloy that includes pressure sensors and localized heating modules.

For example, referring to FIG. 3, in some embodiments, a motor 200 includes tubular housing 102 that encloses a power unit 204 having a stator 220 and a rotor 222. The rotor 222 is formed substantially of a shape memory alloy (e.g., Nitinol) that can expand and contract when heat is applied and removed. The rotor 222 includes devices (e.g., localized heating modules) 223 arranged longitudinally throughout a central region of the rotor 222. The localized heating modules 223 are configured to heat regions of the rotor 222 in order to enlarge the rotor 222, for example, to reduce the spacing between the rotor 222 and the stator 220. The localized heating modules 223 are electrically connected to a downhole electric power generator/controller module to receive electric power and to be controlled. Examples of suitable localized heating modules include electrically insulated nicrome wire mounted on a mandrel inside the stator which is powered by AC or DC current to generate heat from resistance to current flow or inductive heating through the use of copper wire wound on a bobbin inside the stator where AC current cycles through the windings causing eddy currents in the memory metal which then creates resistive heat losses. The stator 220 is typically made substantially of an elastomer (e.g., rubber).

The power unit 204 also includes multiple pressure sensors 225 to monitor pressure of the drilling fluid 90 as it passes through the power unit 204. Pressure sensors 225 are positioned above and below the rotor 222 to monitor the pressure of the drilling fluid 90 entering and exiting the power unit 204. Pressure sensors 225 are also spaced along the rotor 222 (e.g., positioned at each stage of the power unit 204) to monitor the pressure of the drilling fluid 90 as it passes through the localized progressive cavity 134 of the power unit 204. The pressure sensors 225 are configured to detect pressure changes in the drilling fluid 90, such as drops in pressure, for example, pressure drops that suggest that the spacing between the rotor 222 and the stator 220 in that region has increased to a non-suitable spacing or increased due to stator swelling. Examples of suitable pressure sensors include strain gauge based sensors such as Paine 211-50-070 high pressure high temperature sensor or quartz based pressure sensors such as the Quartdyne SPB30K-B high pressure high temperature sensor.

The motor 200 further includes at least one controller 901 disposed in or in proximity to the motor. The controller is adapted to receive, store and process data and output signals as discussed in this disclosure.

Referring to FIGS. 1, 2, and 3, during a drilling operation, the pressurized drilling fluid 90 is forced down the drill string 150 and into the cavity 134 between the rotor 222 and the stator 220, which causes the rotor 222 to rotate within the stator 220 and produce a torque. As a result of the rotating rotor 222, the drill bit 136 rotates and cuts away material at the bottom of the wellbore 75 and the drilling assembly 50 advances deeper into the wellbore 75.

As the drilling operation continues, clearance spacing (the fluid escape gap) between the rotor 222 and the stator 220 can change within a region of the power unit 204, for example, as a result of wear of the rotor 222 or stator 220, as discussed above. As a result of the change in spacing at a region of the power unit 204, the fluid pressure in that region typically also changes. For example, increased spacing in a region between the rotor 222 and the stator 220 typically results in a drop in fluid pressure in that region due to increased leakage across to the next cavity. Therefore, the pressure sensors 225 continually monitor the pressure along the power unit 204 and when the pressure within a particular region drops below a certain level (e.g., a threshold level that indicates that the spacing has increased beyond a suitable range), the localized heating module 223 in that particular region is turned on to heat the rotor 222 in that region. Due to the heat applied, the rotor 222 enlarges and the spacing between the rotor 222 and the stator 220 decreases. Heat is applied to the rotor 222 using the localized heating module 223 until the pressure measured by the pressure sensor 225 has sufficiently increased and is within a desired range to indicate that the spacing between the rotor 222 and the stator 220 is within the desired range.

There are essentially 5 parameters that could be measured or referred to by the controller 901:

1. Ideal performance curve model (manufacturer's chart) which is determined from bench testing the motor to characterize its performance over the operating ranges (see FIG. 8 which illustrates example of a prior art motor performance curve).
2. Rotor RPM
3. Motor Differential Pressure across the power section of the motor
4. Motor Gradient Pressure which is the pressure drop between stages prior to the last stage of the motor which is representative of the leakage pressure.
5. Flow Rate
6. Shaft Output Torque As previously discussed herein, there are many configurations possible for the stator and rotor. One of the goals of the present invention is to restrict the leakage that occurs at the major diameter of the rotor and the minor diameter of the stator. It is here where the motor seal is weakest and shape changing the trough of the rotor and the major diameter of the stator bolsters this part of the seal through a morphing of the shape of the rotor or stator or both.

Figure 8:
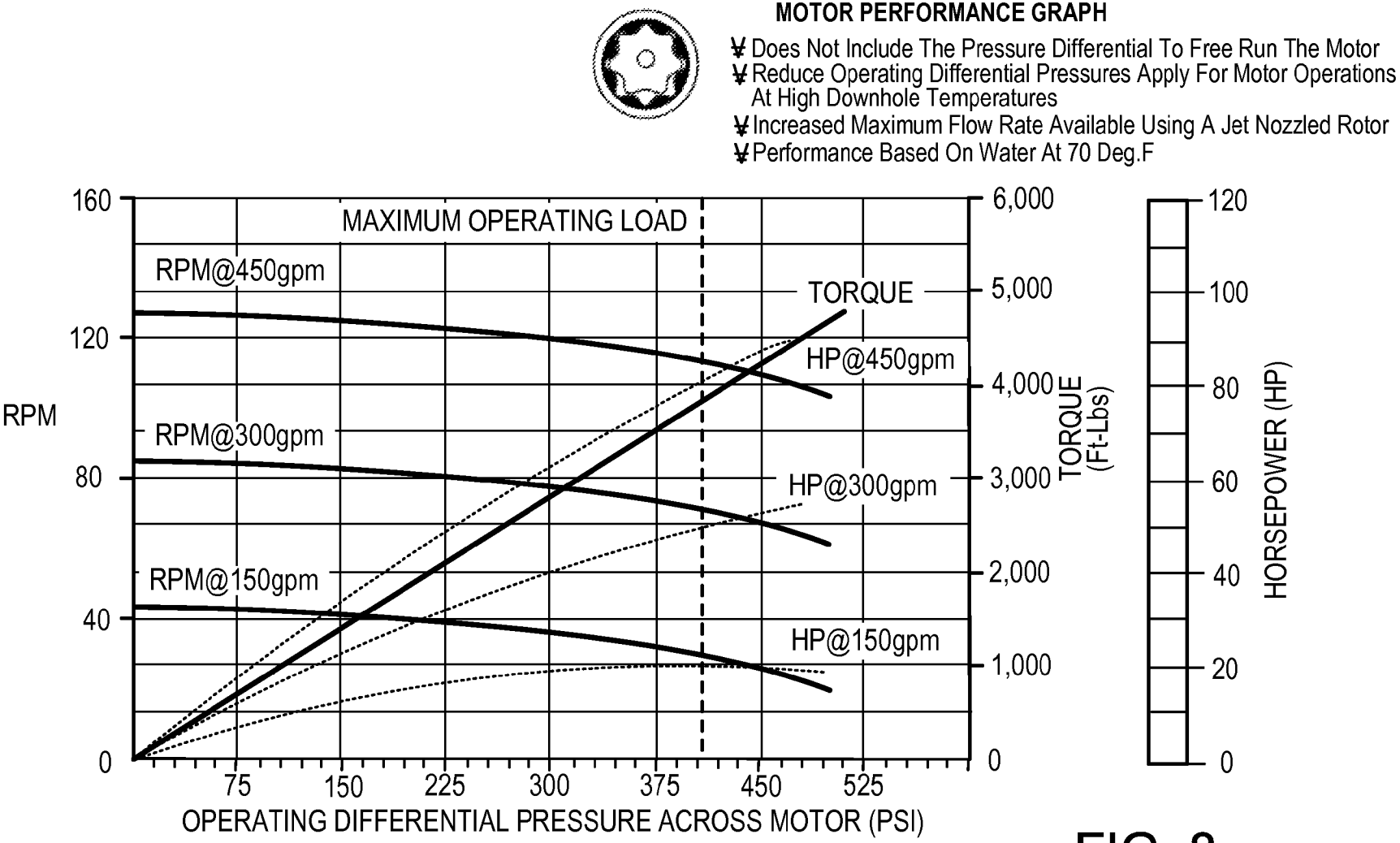
FIG. 8 is an exemplary downhole motor performance curve for a prior art downhole motor.

An exemplary ideal motor performance curve for an exemplary implementation of a prior art motor is illustrated in FIG. 8. This performance curve is developed through testing and/or empirical analysis to determine the optimal operating conditions for an exemplary motor.

By monitoring the RPM, torque, flow rate and differential pressure the efficiency of the motor (which is the hydraulic input power divided by the mechanical output power) can be improved.

$$\eta_{tot} = \frac{P_{mech.}}{P_{hyd.}}$$

Hydraulic power is simply calculated by:

$$P_{hyd} = \Delta p \cdot Q$$

Δp=motor differential pressure

Q=fluid flow rate $$P_{mech} = T \cdot N$$

T=Torque

N=rotation speed

Tiraspolsky determined that the difference between the input and output power consists of power loss from leakage, torque loss due to mechanical friction and power loss due to fluid friction. These 3 efficiencies can be described as:

Volumentric efficiency:

$$\eta_{vol} = \frac{Q_{eff}}{Q_o}$$

Mechanical efficiency:

$$\eta_{mech} = \frac{M_{eff}}{M_o}$$

Hydraulic efficiency:

$$\eta_{hyd} = \frac{P_{eff}}{P_o}$$

Where "o" represents the ideal or no loss parameter.

Thus the total efficiency of the motor in a generalized form can be represented by the formula:

$$N_{tot} = N_{vol} \cdot N_{mech} \cdot N_{hyd}$$

Generally, the efficiencies are not entirely decoupled from each other. However, this disclosure addresses in particular improvement of the hydraulic efficiency of the motor.

Generalizing, the motor has a fixed volume of fluid it can pass per rotation. The effective speed of the motor is calculated by:

$$n_{eff} = \frac{Q_o - Q_f}{V_o}$$

Where:

$N_{eff}$=the effective speed (RPM) of the motor

Q=flow rate into the power section $Q_f$=The leakage flow rate $V_o$=The volume throughput capacity per rotation of the motor Focusing in on the $Q_f$ variable, from Tiraspolsky's teaching we know:

$$\eta_{vol} \cong 1 - A\frac{S_E\sqrt{p_K}}{V_o n_{eff}}$$

Where

A=is a fluid dependent coefficient for the motor $S_E$=The total cross sectional area of the fluid escape gap $P_K$=pressure differential across the motor It is desirable to control $S_E$ by making the escape gap which is the cross-sectional area between the rotor and stator where an ideal seal should occur but actually there is a small varying gap which leakage flow passes through. The goal is to least match the performance of a new motor as much as practical. A reduction of the escape area or gap affects other efficiencies in the motor such as increasing the load on the thrust bearings by having more pressure drop, thus creating more bearing friction so the effort to control $S_E$ requires some balances so as not to lose the benefit gains of volume efficiency to increased losses in the mechanical efficiency or the hydraulic efficiency. Hence, the controller 901 includes or has access to the predetermined motor efficiencies curves.

The fluid dependent coefficient (A) can be characterized for each particular drilling operation based on expected mud weight and viscosity for that drilling operation. A value for A can be stored in the controller prior to the controller and motor being run into the wellbore. The value of A can be changed during the operation as needed via downlinking a new value for A or mode switching to alternate stored values. "A" will generally be determined by performance measurements of new motors prior to use in drilling operations.

It is desirable that the RPM not drop as the torque increases. However, this would require that the motor would have to maintain a frictionless operation from both mechanical friction and fluid friction from leakage. However, in actual drilling operations, as the torque increases the hydraulic power applied to the motor results in proportionally less mechanical power output of the motor as the demand for mechanical power increases. Hence the goal is to maintain the motor performance along acceptable efficiencies for the given output power demand for as long as possible. The manufacturer will often provide a desired performance curve for the motor; however, a performance curve can be generated by measuring the performance of a new motor downhole at the start of the drilling operation run by the controller 901 and determine generally what the performance capabilities are of the motor and then attempt to maintain that performance throughout the remainder of the drilling operation run.

Adjusting the efficiency of the motor is done by adjusting the ability to resist leakage flow $Q_L$ across the power section in the operating range just enough to maintain the motor function along these optimal curves or as close to them as can be obtained. The leakage flow is related to the RPM and the total flow rate because the motor is a constant volume per revolution motor so that the motor cannot make up for flow changes by changing the motor's internal volume. The motor might rotate faster to keep up with the increase in flow. However, as weight is applied to the drill bit, mechanical work must now be done to allow the shaft to rotate so torque is required to continue to rotate the bit against the resistance of the rock. This mechanical work results in an increase in the hydraulic work required by the mud motor. Hence the differential pressure increases across the mud motor to enable this mechanical work. Since the seals are not perfect and the motor is not frictionless some input power is converted to heat. So the power loss is now split between the leakage fluid pressure drop and the mechanical work pressure drop done at the final stage of the motor where the pressure is released that is held within the final stage of the motor.

The motor RPM can be monitored with a Hall effect switch monitoring a magnet mounted on the stator. The controller 901 monitors the number of revolutions per minute of the rotor and can adjust the fit to improve the RPM for the given flow. Generally, if the RPM is lower than it should be it means that fluid is leaking past the stage seals in the power section.

Figure 4:
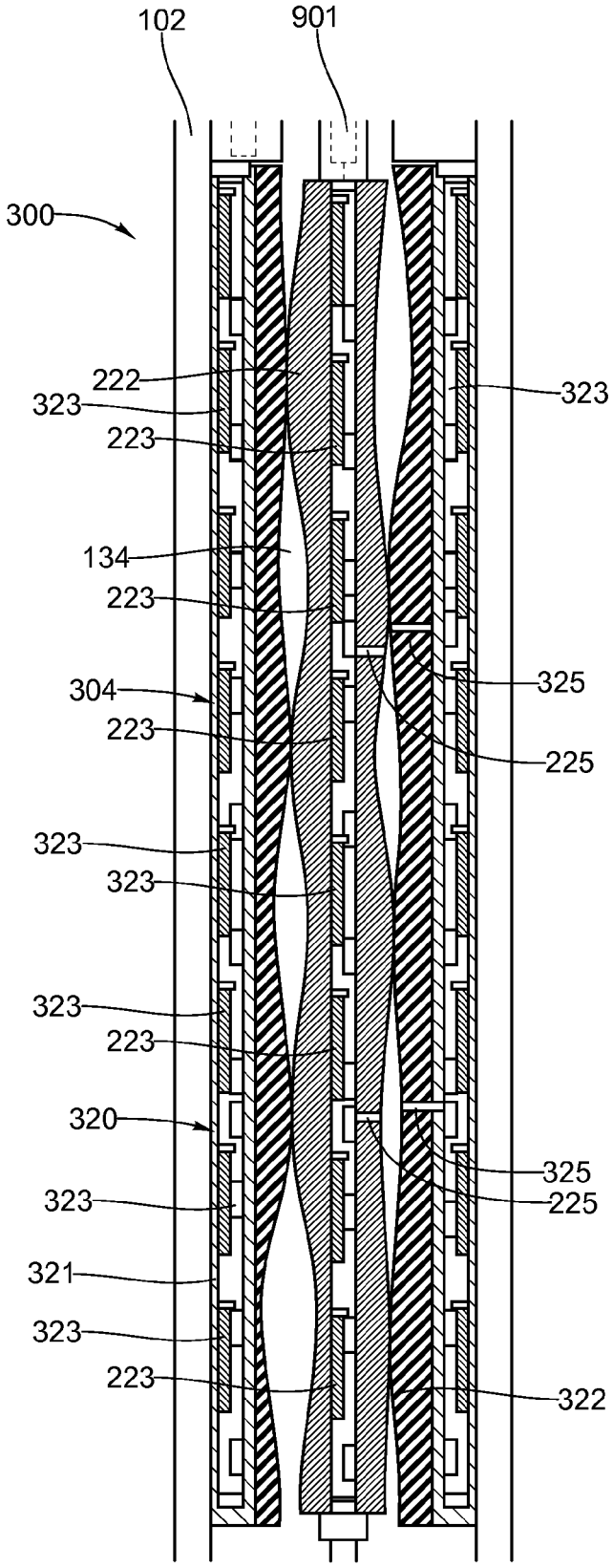
FIG. 4 is a cross-sectional view of an example downhole drilling motor power unit having a rotor and a stator outer sleeve that are both formed of a shape memory alloy and include pressure sensors and localized heating modules.

While the power unit has been described as including a rotor that is formed of a shape memory alloy, other components can alternatively or additionally be formed of a shape memory alloy. For example, referring to FIG. 4, in some embodiments, a motor 300 includes a power unit 304 having a stator 320 that includes a sleeve 321 formed of a shape memory alloy disposed around an inner elastomer portion 322. The inner elastomer portion 322 is shaped to define the stator lobes 124 and the cavity 134. Like the rotor 222, the sleeve 321 includes multiple pressure sensors 325 and localized heating modules 323 so that the size (e.g., thickness) of the sleeve 321 can be adjusted in order to move to stator lobes towards or away from the rotor 222 during use. For example, when the pressure sensors 325 detect that the pressure within the cavity 134 falls below a threshold level, the localized heating modules 323 can apply heat to the sleeve 321 to increase the sleeve's thickness and move the stator 320 towards the rotor 222. As the spacing between the stator 320 and the rotor 222 decreases, the pressure within the cavity 134 increases. As a result, the performance of the power unit 304 can increase. The rotor 222 illustrated in FIG. 4 is substantially similar to the rotor illustrated in FIG. 3, and can be operated as discussed above. Therefore, the stator 320 and the rotor 222 can be heated and moved relative to one another in order to adjust (e.g., optimize) the spacing between the rotor 222 and the stator 320 and the pressure within the cavity 134. However, in some embodiments, the rotor 222 is formed mainly of rubber or other materials and only the stator 320 is adjusted to compensate for changes in the spacing between the rotor 222 and the stator 320.

The stator can also be made of other combinations of components formed of rubber and shape memory alloy. For example, referring to FIG. 5, in some embodiments, a motor 400 includes a power unit 404 having a stator 420 made of an outer portion 421 and an inner layer portion 422. The outer portion 421 is formed of a shape memory alloy and substantially defines the profile and shape of the lobes 124 and the cavity 134. The inner layer portion 422 is typically formed of a rubber material and has a substantially consistent thickness.

Figure 5:
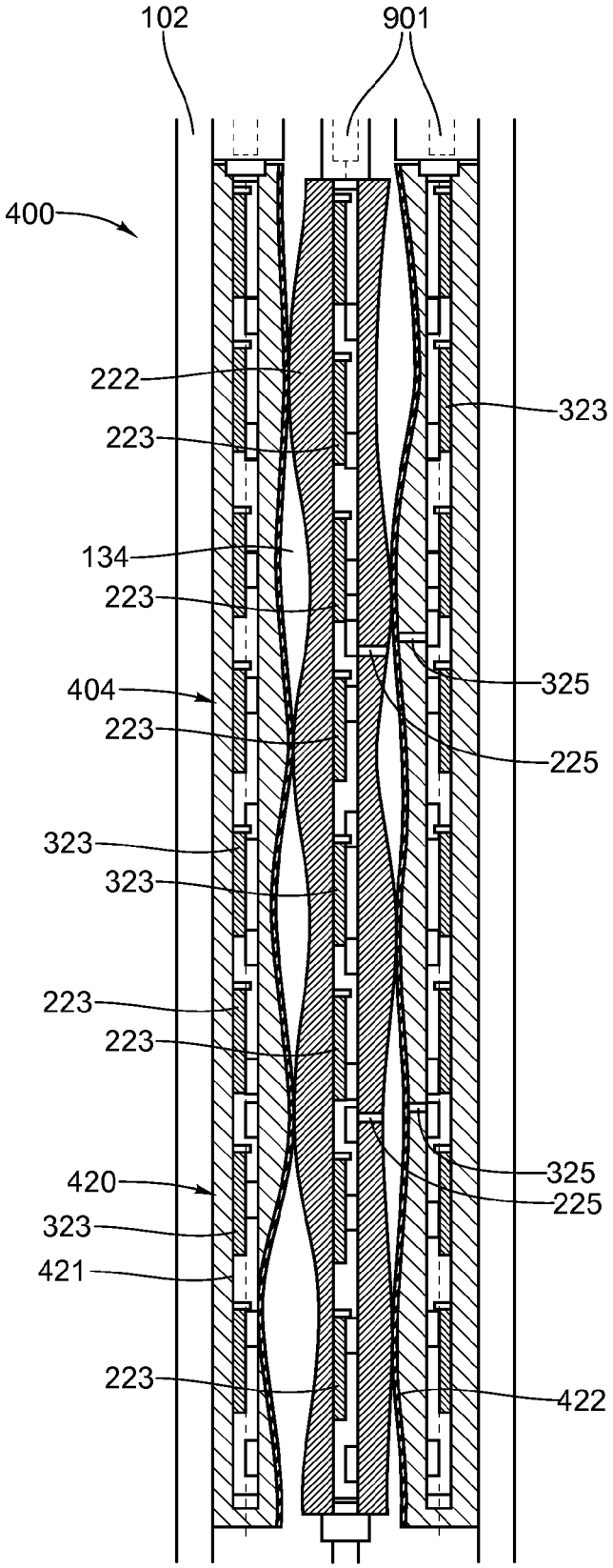
FIG. 5 is a cross-sectional view of an example downhole drilling motor power unit having a rotor and a stator outer portion that are both formed of a shape memory alloy and include pressure sensors and localized heating modules.

Similar to the sleeve 321 discussed above with reference to FIG. 4, the outer portion 421 of the stator 420 includes pressure sensors 325 that are configured to monitor pressure in the cavity 134 between the rotor 222 and the stator 420 in order to detect wear on either the rotor 222 or the stator 420 and the resulting changes in the compression between the rotor 222 and the stator 420. The outer portion 421 also includes localized heating elements 323 that are configured to heat the outer portion 421 to change its size, based on the monitored pressure in the cavity 134. For example, when the pressure drops below a threshold pressure, the localized heating elements 323 apply heat to the outer portion 421 so that it enlarges (e.g., increases in thickness) and moves the inner layer portion 422 towards the rotor 222. As a result, the spacing between the rotor 222 and stator 420 is decreased and the pressure in the cavity 134 increases. The localized heating elements 323 continue to heat the outer portion 421 until the pressure sensors 325 determine that the pressure in the cavity 134 is above the threshold pressure in order to maintain or improve performance of the power unit 404. The rotor 222 illustrated in FIG. 5 is substantially similar to the rotor illustrated in FIGS. 3 and 4, and can be operated as discussed above. However, in some embodiments, the rotor 222 is formed mainly of rubber or other materials and only the stator 420 is adjusted to compensate for changes in the spacing between the rotor 222 and the stator 420.

While the rotors and stators have been described as being formed of substantially solid structures, other structural arrangements are possible. For example, referring to FIG. 6, in some embodiments, a motor 500 includes a power unit 504 having a stator 520 having an outer portion that is formed of a wire frame structure 521 made from shape memory alloy that substantially defines the profile and shape of the lobes 124 and cavity 134. The stator 520 also includes an inner layer portion 422 that is typically made of a rubber material and has a substantially consistent thickness. The inner layer portion 422 is disposed along an inner surface defined by the wire frame structure 521. The wire frame structure 521 includes pressure sensors 325 that are configured to monitor pressure in the cavity 134 between the rotor 222 and the stator 520.

The wire frame structure 521 also includes electrical devices 523 that are configured to apply an electric current to the wires of the wire frame structure 521. Due to the electrical current flowing through selectable wires as controlled by the controller, the shape memory alloy of the wire frame structure 521 expands and/or contracts, enlarging or shrinking the wire frame structure 521 as a whole. As a result of the expanding and contracting of the wire frame structure 521, the inner layer portion 422 moves towards or away from the rotor 222, which decreases or increases the compression between the rotor 222 and the stator 520. Typically, the wire frame structure 521 is configured to contract (i.e., increase the spacing between the rotor and stator) when energized with the electric current and then expand when the electric current is no longer applied. Further, increasing the ability to control the spacing between the stator 520 and the rotor 222, the wire arrangement of the wire frame structure 521 can be designed specifically for desired expansion and contraction characteristics. For example, the wires can be laid out and arranged such that the wire frame structure 521 enlarges substantially only in certain regions (e.g., in the proximity of the lobes 124) when electrical current is applied. Such wires are known to those skilled in the art and are used in many robotic applications. They are often referred to as "Smart Muscles" or "muscle wires." An exemplary product is Flexinol muscle wire by MONDOTRONICS. When current flows through the wire the wire contracts in length typically, or can relax or extend its length depending on the training of the memory metal to allow the wire to change length. Depending on the placement of wires in the stator, the shape of the stator can be altered by running electric current through the wire to cause the wire change length which then changes the shape of the rubber it is connected to, thus changing the radial compression fit.

Figure 6:
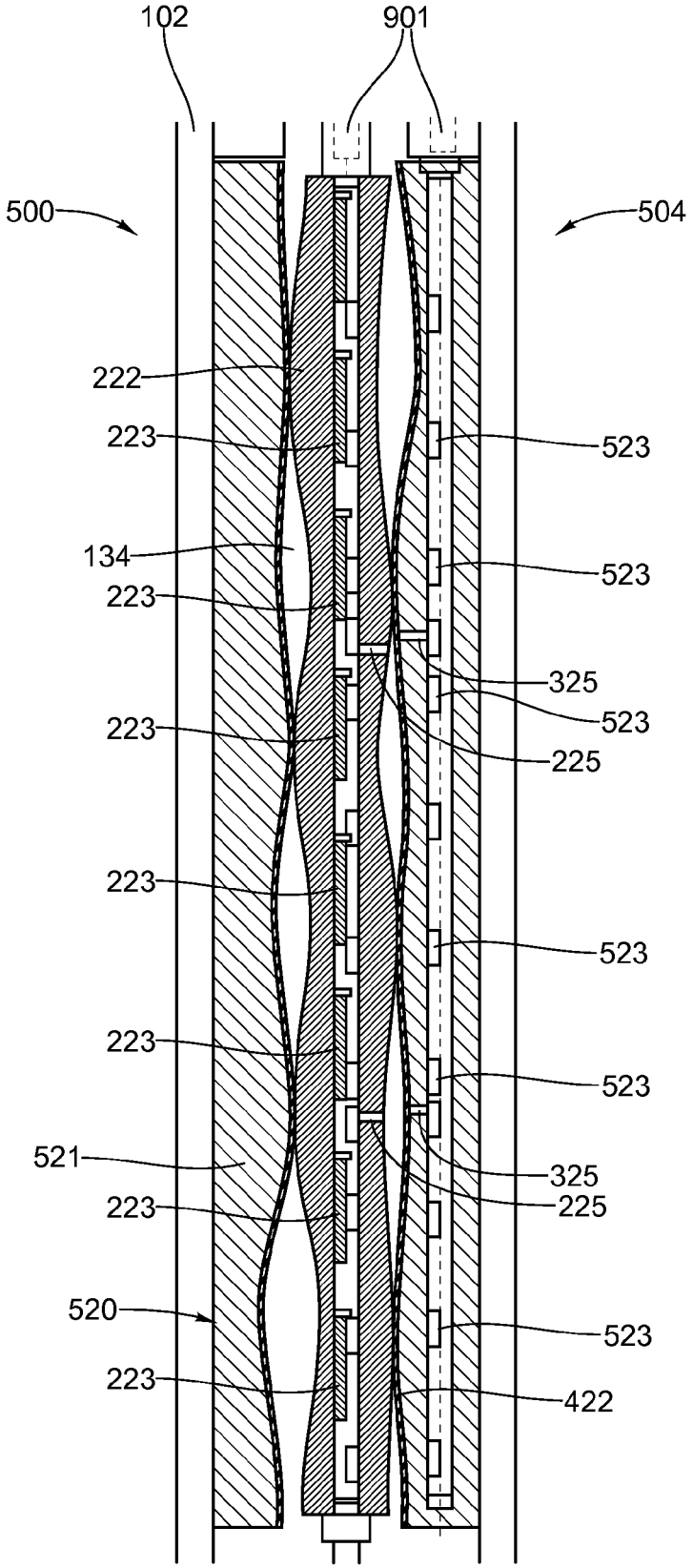
FIG. 6 is a cross-sectional view of an example downhole drilling motor power unit having a substantially solid rotor and a wire frame stator that are both formed of a shape memory alloy and include pressure sensors and localized heating modules.
Figure 7A:
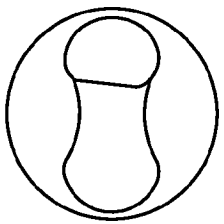
FIGS. 7A to 7K illustrate exemplary configurations of some implementations of stator and rotor lobes.
Figure 7B:
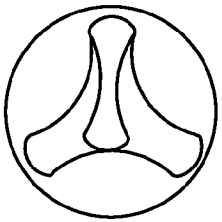
Figure 7C:
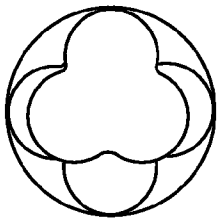
Figure 7D:
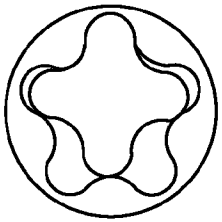
Figure 7E:
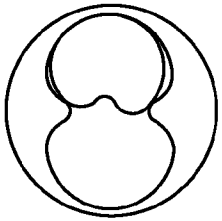
Figure 7F:
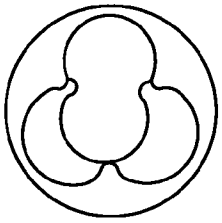
Figure 7G:
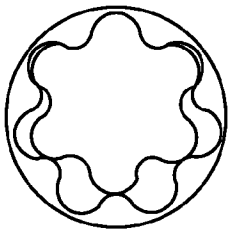
Figure 7H:
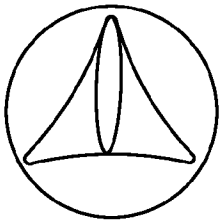
Figure 7I:
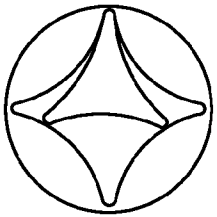
Figure 7J:
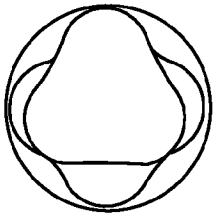
Figure 7K:
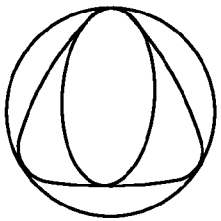

The rotor 222 illustrated in FIG. 6 is substantially similar to the rotor illustrated in FIGS. 3, 4, and 5, and can be operated as discussed above. However, in some embodiments, the rotor 222 is formed mainly of rubber or other materials and only the stator 520 is adjusted to compensate for changes in the spacing between the rotor 222 and the stator 520. In some embodiments, the rotor is alternatively or additionally formed of a wire frame structure that can be expanded or contracted to adjust the spacing between the rotor and the stator.

A number of embodiments have been described. Nevertheless, it will be understood that various modifications may be made without departing from the spirit and scope of the invention. Accordingly, other embodiments are within the scope of the following claims.

What is claimed is:

1. A downhole drilling motor for well drilling operations, the downhole drilling motor comprising:

a tubular housing;

a stator disposed in the tubular housing, said stator having an internal cavity passing therethrough, wherein the stator includes one or more lobes defining at least a portion of the cavity;

a rotor operatively positioned in the internal cavity to cooperate with the one or more lobes of the stator; and at least one localized heating module;

wherein at least a portion of the stator or at least a portion of the rotor comprises a memory material adapted to expand or contract when heat is applied by the localized heating module to the memory material.

2. The motor of claim 1 wherein a fluid escape gap between the rotor and stator is adjusted by applying heat to the rotor and/or stator.

3. The motor of claim 1 further including:

at least one controller adapted to receive input data and provide output signals increasing and/or decreasing electrical current applied to the at least one localized heating module.

4. The motor of claim 3, wherein the rotor further comprises a pressure sensor that is configured to detect the pressure within the cavity and provide pressure data to the controller.

5. The claim 3, wherein the stator further comprises a pressure sensor that is configured to detect the pressure within the cavity and provide pressure data to the controller.

6. The motor of claim 1 wherein at least a portion of the rotor comprises the memory material.

7. The motor of claim 6 wherein the rotor further comprises the at least one localized heating module.

8. The motor of claim 1 wherein at least a portion of the stator comprises the memory material.

9. The motor of claim 8 wherein the stator comprises an outer portion and an inner portion and wherein at least a portion of the outer portion is comprised of the memory material.

10. The motor of claim 9 wherein the stator further comprises the at least one heating device.

11. The motor of claim 9 wherein the inner portion of the stator substantially defines the internal cavity and the inner portion has a generally consistent thickness and is disposed along an inner surface of the outer portion.

12. The motor of claim 9 wherein the outer portion of the stator is a sleeve having a generally consistent thickness and the inner portion substantially defines the internal cavity.

13. The motor of claim 9, wherein the inner portion of the stator is comprised of rubber.

14. The motor of claim 1 wherein the memory material comprises a shape memory alloy.

15. A downhole drilling motor for well drilling operations, the downhole drilling motor comprising:

a tubular housing;

a stator disposed in the tubular housing, said stator having an internal cavity passing therethrough, wherein the stator includes one or more lobes defining at least a portion of the cavity, the stator comprising:

a wire frame structure that generally defines the internal cavity, a portion of the stator being comprised of a memory material and adapted to expand and contract based on increasing or decreasing electric current applied to the memory material; and at least one electrical control device configured to increase or decrease electric current supplied to the memory material; and a rotor operatively positioned in the internal cavity to cooperate with the one or more lobes of the stator.

16. The motor of claim 15 wherein the stator further comprises an inner portion disposed along an inner surface defined by the wire frame structure and wherein the inner portion is comprised of rubber and wherein the memory material comprises a shape memory alloy.

17. The motor of claim 15 wherein a fluid escape gap between the rotor and stator is adjusted by applying heat to the rotor and/or stator.

18. The motor of claim 15 wherein the electrical control device is adapted to receive input data and provide output signals to increase or decrease electric current applied to the memory material.

19. The motor of claim 18 wherein the stator further comprises a pressure sensor that is configured to detect pressure data within the cavity and provide input data comprising the pressure data to the electrical control device.

20. A rotor and a controller for use in a downhole drilling motor for well drilling operations, the controller being disposed in the motor and the controller being adapted to receive input data and provide output signals adjusting electrical current, and wherein the rotor is configured to be operatively positioned within an internal cavity of a stator disposed in a tubular housing of the downhole drilling motor, said rotor adapted to cooperate with one or more lobes of the stator, the rotor comprising:

at least one pressure sensor configured to detect the pressure within the internal cavity and provide pressure data to the controller; and at least a portion of the rotor comprises a memory material adapted to expand or contract when electric current applied to the memory material is increased or decreased by the controller disposed in the motor.

21. A stator and a controller for use in a downhole drilling motor for well drilling operations, the controller being disposed in the motor and the controller being adapted to receive input data and provide output signals adjusting electrical current, and wherein the stator comprises:

one or more lobes defining at least a portion of an internal cavity, said cavity adapted to receive a rotor and wherein at least a portion of the stator comprises a memory material adapted to expand or contract when electric current applied to the memory material is increased or decreased by the controller disposed in the motor; and at least one pressure sensor configured to detect the pressure within the internal cavity and provide pressure data to the controller.

22. A method of operating a downhole drilling motor in a well drilling operation, the method including the steps of:

introducing a drilling fluid into a first end of a downhole drilling motor;

forcing the drilling fluid through a cavity between a rotor and a stator of the downhole drilling motor with sufficient pressure to cause the rotor to rotate relative to the stator;

with a controller disposed in the downhole drilling motor, monitoring the pressure of the drilling fluid in at least one portion of the cavity between the rotor and stator;

responsive to the pressure in the at least one portion of the cavity, selectively providing heat to a portion of the stator or rotor formed from a memory material disposed proximal to the cavity; and expanding or contracting the memory material to reduce or increase a spacing between the rotor and the stator in the at least one portion of the cavity.

23. The method of claim 22, wherein the rotor and/or the stator are enlarged at multiple positions in the cavity in the downhole drilling motor.

24. The method of claim 23 further including adjusting the motor efficiency by expanding or contracting the memory material to adjust the spacing between the stator and rotor.

25. The method claim 23 further including adjusting output torque of the motor.

26. The method of claim 23 further including adjusting rotational speed of the motor.

27. The method of claim 22 further including:

receiving by the controller data selected from the group consisting of: motor RPM, input drilling fluid flow rate, output torque; motor differential pressure; and motor gradient pressure.

28. The method of claim 27 further including calculating by the controller a motor efficiency.

29. A method of operating a downhole drilling motor in a well drilling operation, the method including the steps of:

introducing a drilling fluid into a first end of a downhole drilling motor;

forcing the drilling fluid through a cavity between a rotor and a stator of the downhole drilling motor with sufficient pressure to cause the rotor to rotate relative to the stator;

with a controller disposed in the downhole drilling motor, monitoring the pressure of the drilling fluid in at least one portion of the cavity between the rotor and stator;

responsive to the pressure in the at least one portion of the cavity, selectively providing electric current to a portion of the stator or rotor formed from a memory material disposed proximal to the cavity; and expanding or contracting the memory material to reduce or increase a spacing between the rotor and that stator in the at least one portion of the cavity.

* * * * *

UNITED STATES PATENT AND TRADEMARK OFFICE

CERTIFICATE OF CORRECTION

PATENT NO. : 8,899,351 B2
APPLICATION NO. : 14/236057
DATED : December 2, 2014
INVENTOR(S) : Richard Thomas Hay et al.

It is certified that error appears in the above-identified patent and that said Letters Patent is hereby corrected as shown below:

In the Claims

Column 11, Line 33, after "The", please insert -- motor of --

Column 11, Line 36, please replace "1" with -- 1, --

Column 11, Line 40, please replace "1" with -- 1, --

Column 13, Line 14, after "method", please insert -- of --

Signed and Sealed this
Thirty-first Day of March, 2015

Michelle K. Lee

Michelle K. Lee
*Director of the United States Patent and Trademark Office*